US011251570B2

(12) United States Patent
Chen et al.

(10) Patent No.: US 11,251,570 B2
(45) Date of Patent: Feb. 15, 2022

(54) ELECTRICAL CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Chao-Chieh Chen, New Taipei (TW); Jhih-Yao Jiang, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/138,832

(22) Filed: Dec. 30, 2020

(65) Prior Publication Data

US 2021/0203110 A1 Jul. 1, 2021

(30) Foreign Application Priority Data

Dec. 31, 2019 (CN) ..... 201911413563.2

(51) Int. Cl.

| | |
|---|---|
| ***H01R 12/00*** | (2006.01) |
| ***H01R 13/6474*** | (2011.01) |
| ***H01R 13/24*** | (2006.01) |
| *H01R 12/70* | (2011.01) |
| *H01R 13/50* | (2006.01) |

(52) U.S. Cl.

CPC ..... *H01R 13/6474* (2013.01); *H01R 13/2435* (2013.01); *H01R 12/7076* (2013.01); *H01R 12/7082* (2013.01); *H01R 13/50* (2013.01)

(58) Field of Classification Search

CPC ... H01R 23/722; H01R 31/00; H01R 13/2442
USPC ..... 439/66, 91, 591, 862
See application file for complete search history.

(56) References Cited

U.S. PATENT DOCUMENTS

| | | | | |
|---|---|---|---|---|
| 7,878,818 | B2 | 2/2011 | Hai | |
| 8,202,100 | B2 * | 6/2012 | Luo | H01R 13/2435 439/66 |
| 9,172,161 | B2 | 10/2015 | Amphenol | |
| 10,797,424 | B2 * | 10/2020 | Hsu | H01R 12/7082 |

(Continued)

FOREIGN PATENT DOCUMENTS

| | | | |
|---|---|---|---|
| CN | 109713477 | A | 5/2019 |

*Primary Examiner* — Phuong Chi Thi Nguyen
(74) *Attorney, Agent, or Firm* — Ming Chieh Chang; Wei Te Chung

(57) ABSTRACT

A plurality of contacts are disposed within the corresponding passageways of the housing of the electrical connector, respectively. Each contact includes a main body extending in a vertical plane with two pairs of fixing sections on two opposite lateral sides to form an X-like shape, and a pair of resilient contacting arms extending from opposite upper and lower ends of the main body for mating with the CPU and PCB. A pair of extension arms extend from the waist section of the main body in a direction perpendicular to the vertical plane. The contacting arm includes a vertical section coplanar with the main body, an oblique section extending from an upper end of the vertical section with a bulged and narrowed contacting section at the free end. Each pair of fixing sections are located by two sides of the vertical section of the corresponding contacting arm.

20 Claims, 10 Drawing Sheets

(56) References Cited

U.S. PATENT DOCUMENTS

| | | | | |
|---|---|---|---|---|
| 10,833,441 | B2 * | 11/2020 | Hsu | H01R 4/02 |
| 11,128,072 | B1 * | 9/2021 | Consoli | H01R 13/24 |
| 2021/0203110 | A1 * | 7/2021 | Chen | H01R 13/6474 |

* cited by examiner

ELECTRICAL CONNECTOR

BACKGROUND OF THE INVENTION

1. Field of the Invention

The present invention relates to an electrical connector for use with a CPU (Central Processing Unit), and particularly to the electrical contact for use within the electrical connector.

2. Description of Related Arts

U.S. Pat. No. 7,878,818 discloses an electrical connector with a plurality of contacts. Each contact has a planar main body with a pair of retaining bars on two lateral sides for engagement with the housing, and a pair of resilient contacting arms extending from opposite upper and lower ends for contacting the CPU and the PCB (Printed Circuit Board). Anyhow, the structure of the contact may not fit for high frequency transmission.

Therefore, it is desired to provide an electrical connector with corresponding contacts for high speed and high frequency transmission.

SUMMARY OF THE INVENTION

To achieve the above object, an electrical connector includes an insulative housing with a plurality of passageways extending therethrough in the vertical direction. A plurality of contacts are disposed within the corresponding passageways, respectively. Each contact includes a main body extending in a vertical plane with two pairs of fixing sections on two opposite lateral sides to form an X-like shape, and a pair of resilient contacting arms extending from opposite upper and lower ends of the main body for mating with the CPU and PCB. A pair of extension arms extend from the waist section of the main body in a direction perpendicular to the vertical plane. The contacting arm includes a vertical section coplanar with the main body, an oblique section extending from an upper end of the vertical section with a bulged and narrowed contacting section at the free end. Each pair of fixing sections are located by two sides of the vertical section of the corresponding contacting arm in a coplanar manner. In each contacting arm, the width of the oblique section is larger than the vertical section while being essentially same with a distance defined by the pair of extension arms so as to achieve the impedance matching for high frequency transmission.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
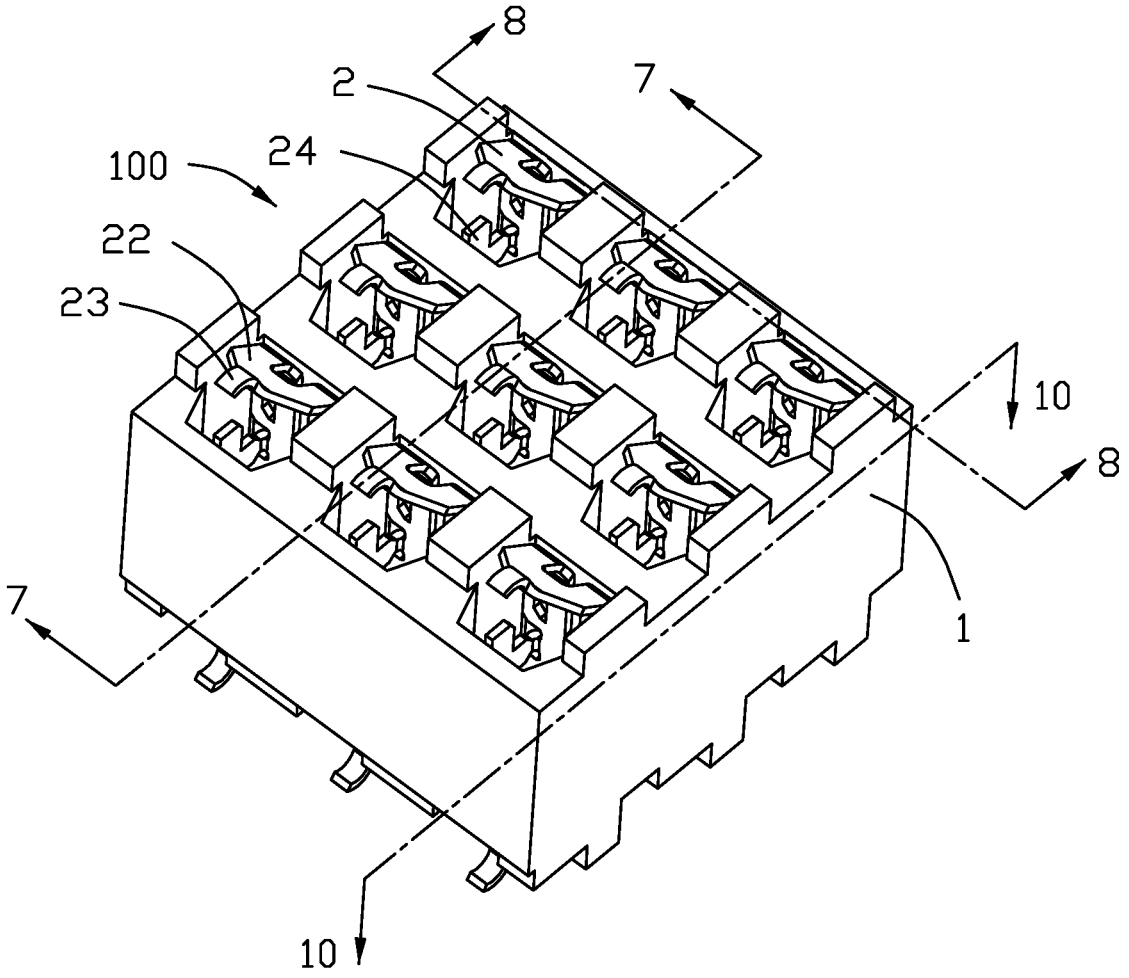
FIG. 1 is a perspective view of an electrical connector according to the invention.
Figure 2:
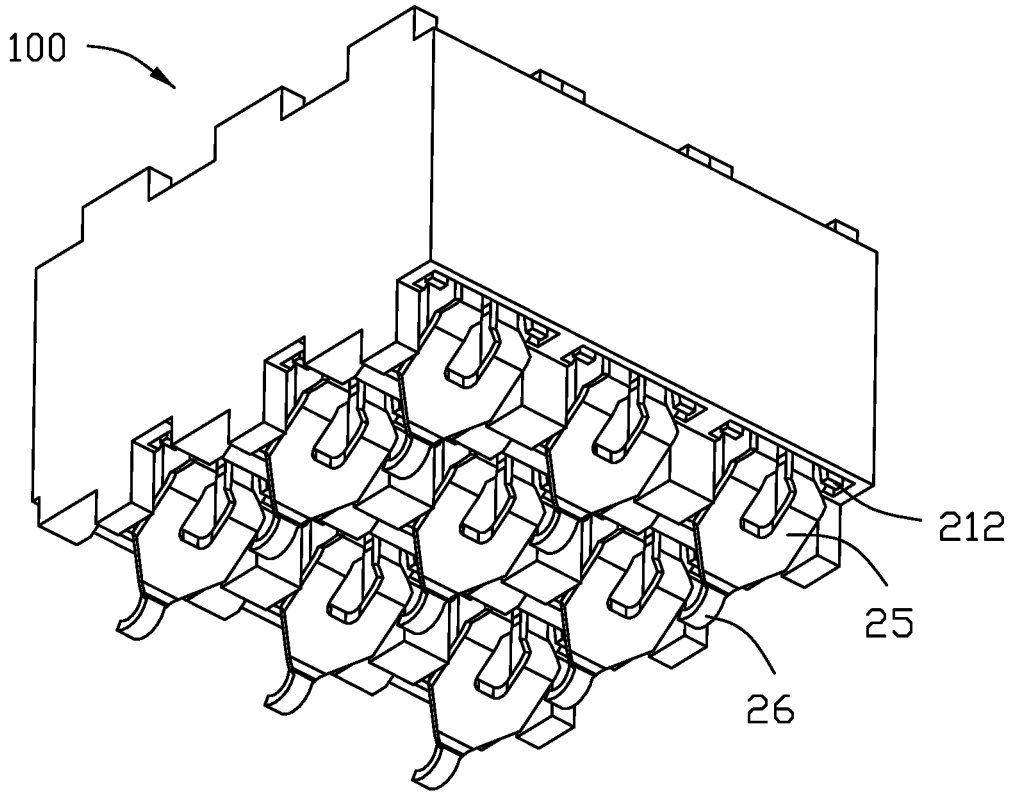
FIG. 2 is another perspective view of the electrical of FIG. 1.
Figure 3:
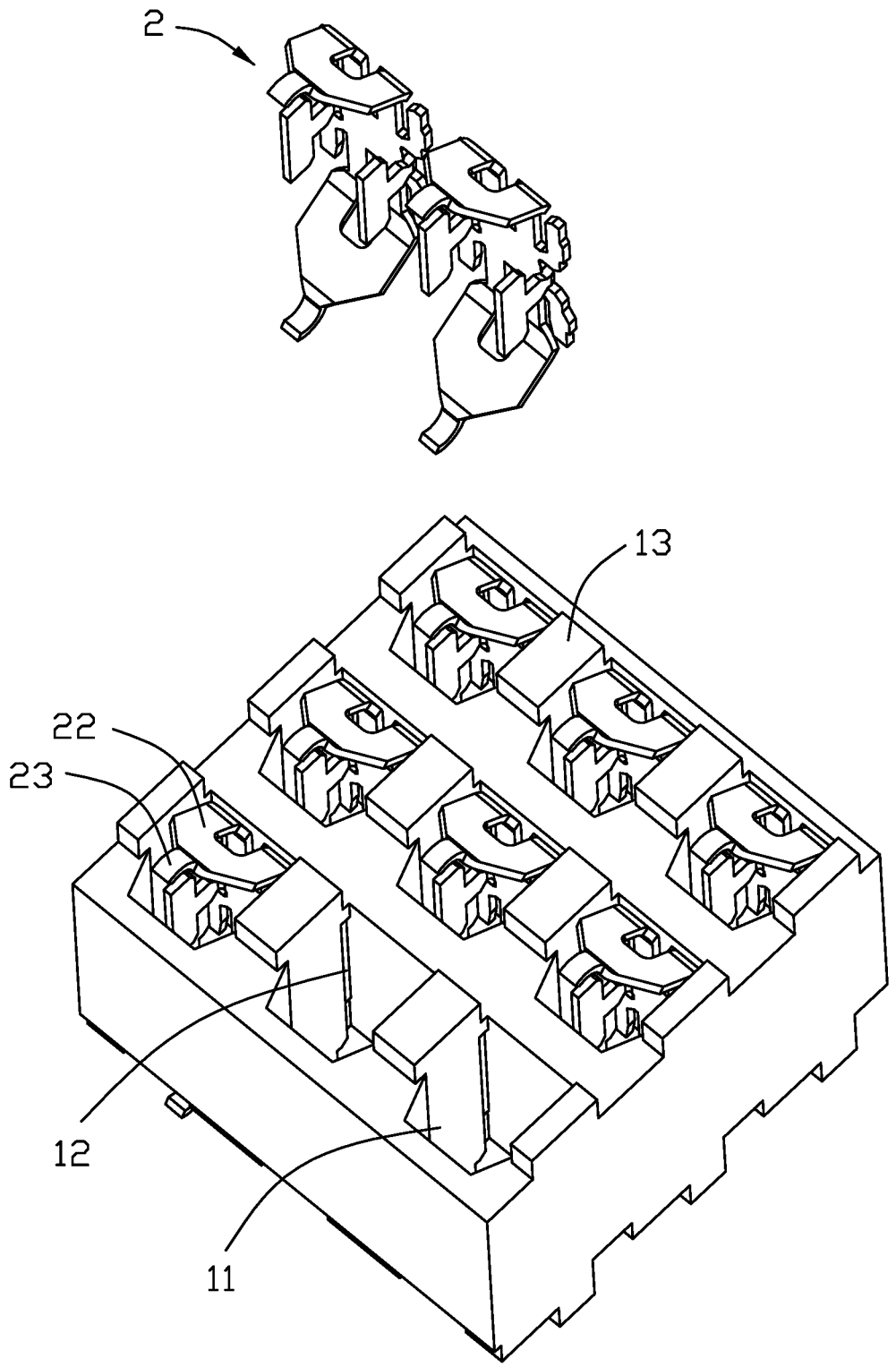
FIG. 3 is an exploded perspective view of the electrical connector of FIG. 1.
Figure 4:
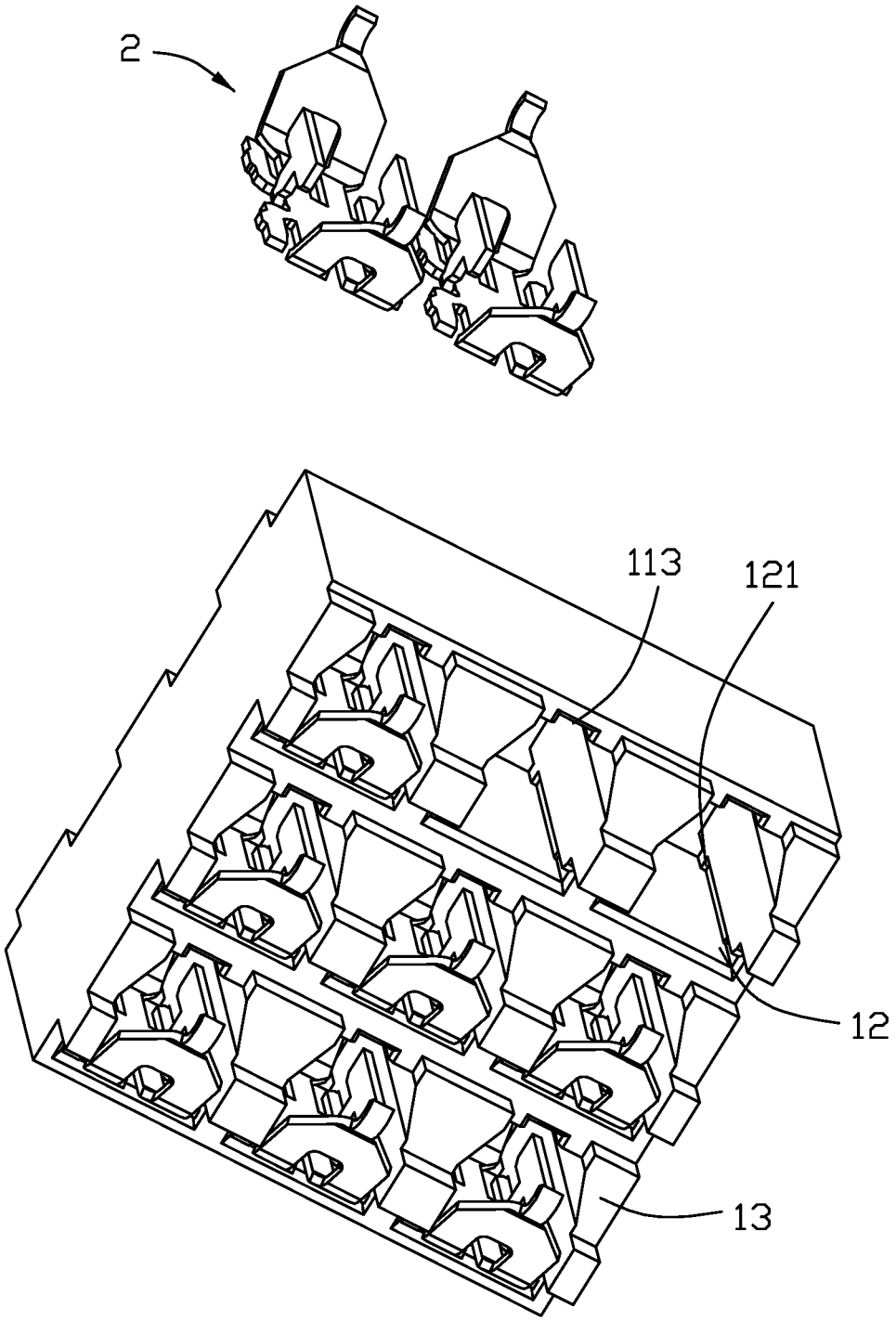
FIG. 4 is another exploded perspective view of the electrical connector assembly of FIG. 3.
Figure 5:
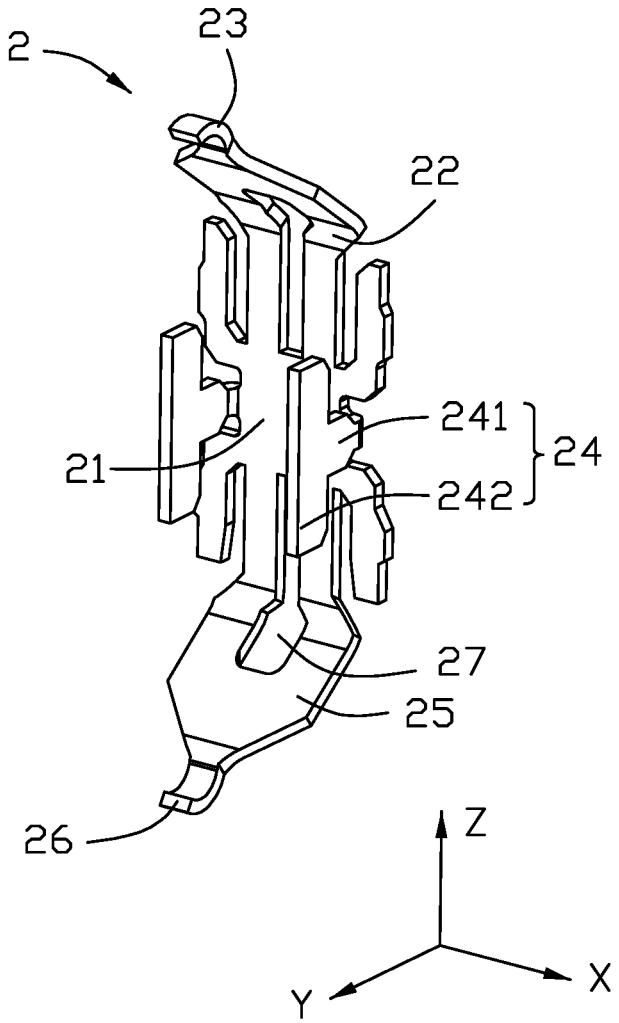
FIG. 5 is a perspective view of the contact of the electrical connector of FIG. 3.
Figure 6:
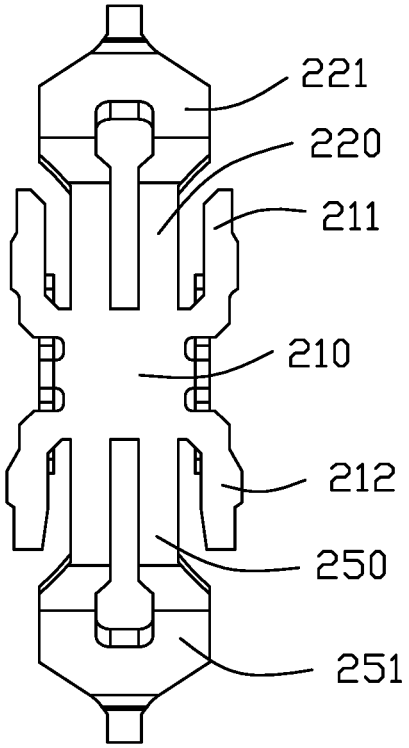
FIG. 6 is an elevational view of the contact of the electrical connector of FIG. 5.
Figure 7:
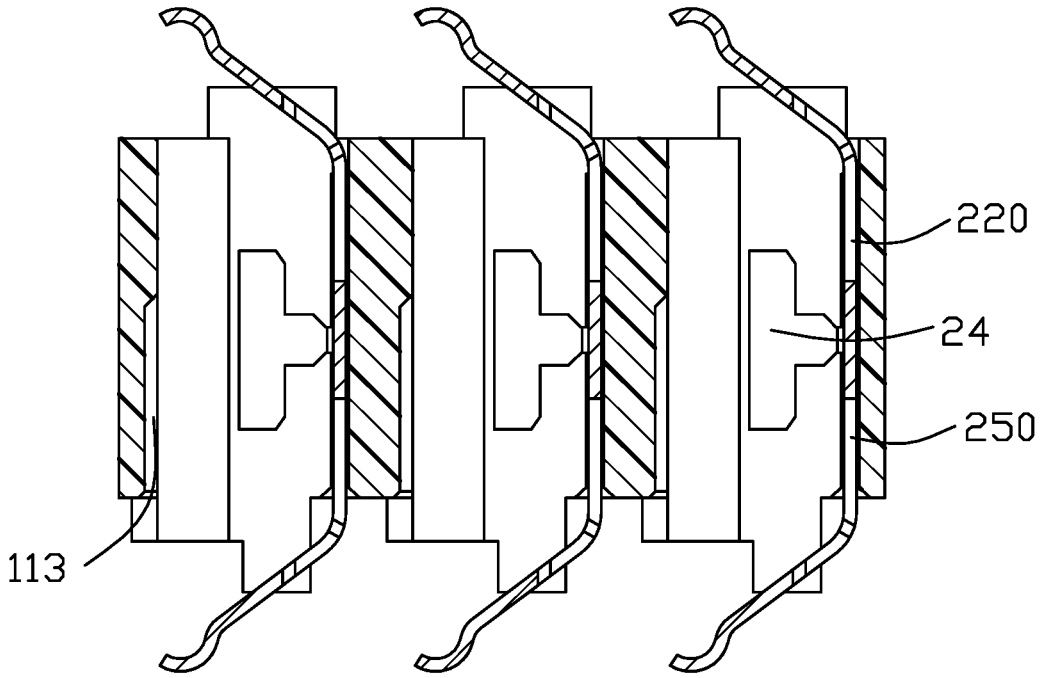
FIG. 7 is a cross-sectional view of the electrical connector of FIG. 1 along line 7-7.
Figure 8:
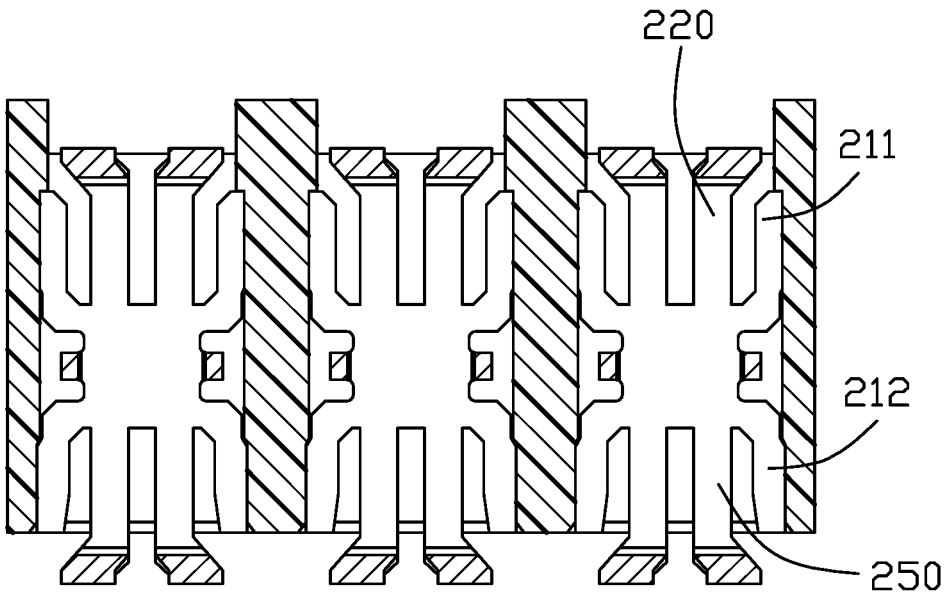
FIG. 8 is a cross-sectional view of the electrical connector of FIG. 1 along line 8-8.
Figure 9:
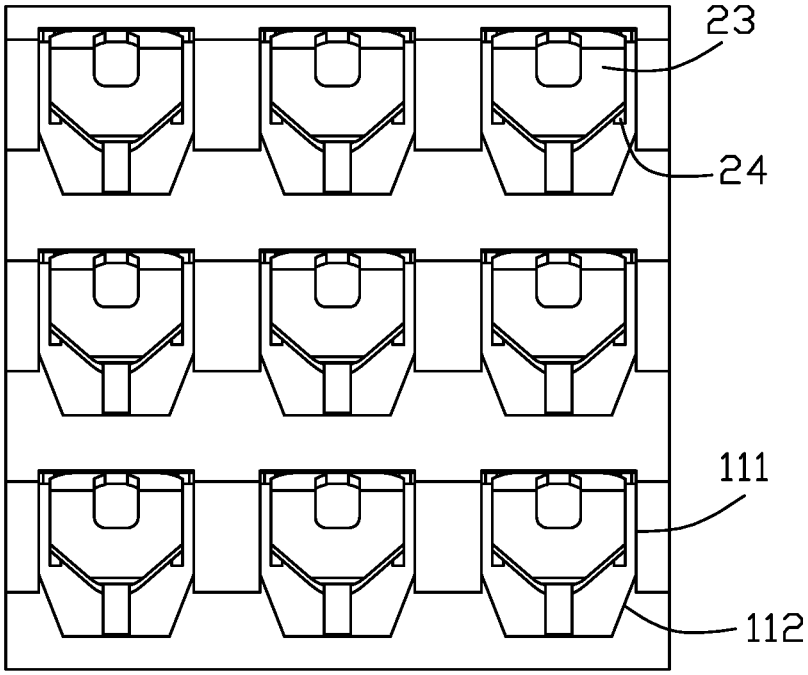
FIG. 9 is a top view of the electrical connector of FIG. 1.
Figure 10:
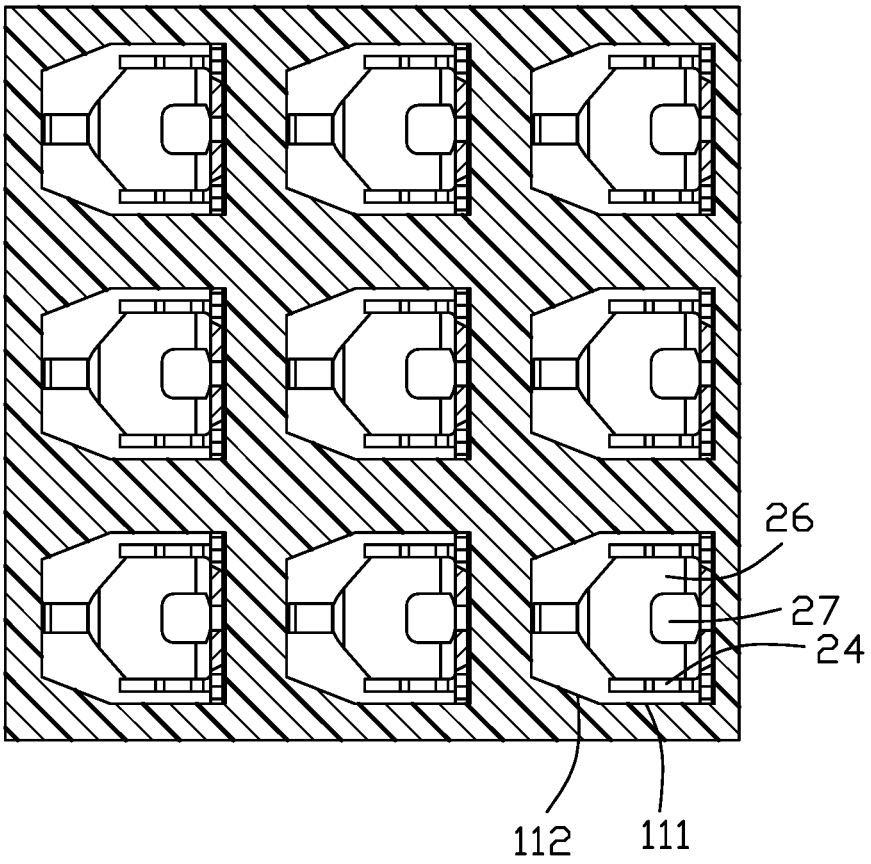
FIG. 10 is a cross-sectional view of the electrical connector of FIG. 1 along line 10-10.

Referring to FIGS. 1-10, an electrical connector 100 for receiving a CPU or electronic package, includes an insulative housing 1 with a plurality of passageways 11 extending through in the vertical direction Z. Each passageway 11 is equipped with a retaining groove 12 on one side. A plurality of contacts 2 are disposed in the corresponding passageways 11, respectively. A plurality of standoffs 13 are located upon opposite upper and lower surfaces of the housing 1 for preventing excessive deflection of the contacts 2.

The contact 2 includes a main body 21 extending in a vertical plane, and opposite upper/first contacting arm 22 and lower/second contacting arm 25 respectively extend from opposite upper and lower ends of the main body 21. The upper contacting arm 22 includes an (upper) vertical section 220 extending from the upper end of the main body 21 in a coplanar manner, and an (upper) oblique section 221 extends from the upper end of the vertical section 220 with a bulged and narrowed (upper) contacting section 23 at a free end thereof. The oblique section 221 extends in both the vertical direction and a longitudinal direction Y perpendicular to the vertical direction Z. An (upper) opening 27 extends in both the vertical section 220 and the oblique section 221. Similar to the upper contacting arm 22, the lower contacting arm 25 is correspondingly configured with the (lower) vertical section 250, the (lower) oblique section 251, the (lower) opening 27 and the (lower) contacting section 26 in a mirror image so as to be roughly symmetrical with regard to the upper contacting arm 22 in the vertical direction. When assembled, the oblique section 221 of the upper contacting arm 22 extends upward above the upper surface of the housing 1, and the oblique section 251 of the lower contacting arm 25 extend downwardly below the lower surface of the housing 1.

The main body 21 includes essentially a base 210, and a pair of upper fixing sections 211, and a pair of lower fixing sections 212 respectively extend from opposite upper and lower sides of the base 210 and located by two sides of the corresponding upper contacting arm 22 and the lower contacting arm 25 in a transverse direction X perpendicular to both the vertical direction Z and the longitudinal direction Y. Both pairs of upper fixing sections 211 and lower fixing sections 212 are retained in the retaining groove 12. In this embodiment, the contact 2 is upwardly assembled into the corresponding passageway 11 wherein the housing 1 forms a pair of shoulders 121 around an upper end of the retaining groove 12 to prevent further upward movement of the upper fixing sections 211. Generally, the main body 21 including the base 211, the upper fixing section 211 and the lower fixing sections 212, forms an X-like configuration in the elevational view.

The contact 2 further includes a pair of extension arms 24 respectively extend from two opposite lateral sides of the base 211 around the waist section thereof. Each extension arm 24 extends in another vertical plane perpendicular to vertical plane defined by the main body 21, while the pair of extension arms 24 are spaced from each other in the transverse direction perpendicular to the vertical plane defined by each extension arm 24. Each extension arm 24 includes a narrow connecting section 241 which extends from the base 211 of the main body 21 and is located between the corresponding upper fixing member 211 and lower fixing member 212 in the vertical direction, and an enlarged/expanded section 242 extends from the narrow connecting n section 241 in the longitudinal direction with an adjustable dimension in either the vertical direction or the longitudinal direction for impedance matching consideration.

In the transverse direction, a width of the oblique section 221 is larger than that of the vertical section 220 while being similar to a distance defined between the pair of extension arms 24. A distance between the two (upper) oblique sections 221 or two (lower) oblique sections 251 of two neighboring contacts 2 is around 0.42 mm while that between the two upper fixing sections 211 or two lower fixing sections 212 of the two neighboring contacts 2 is around 0.23 mm.

The main body 21 abuts against one interior face of the corresponding passageway 11 while the pair of extension arms 24 is spaced from any interior faces of the passageway 11 for impedance matching adjustment. The passageway 11 includes a pair of parallel interior faces 111 and a pair of converging interior faces 112 to comply with the configuration of the contacting arms 22, 25. In this embodiment, the dimension of the passageway 11 in the longitudinal direction, i.e., the extension direction of the contacting arm, is slightly larger than the dimension of the upper contacting arm along the longitudinal direction when the contacting arm is in a relaxed manner so as to allow the contact 2 to be upwardly assembled into the passageway 11 from the lower surface of the housing 1. A plurality of recesses 113 are formed in the lower surface of the housing for forgiving any improper over-deflection of the corresponding lower contacting arm 25, during upward assembling the contact 2 into the passageway 11.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing forming a plurality of passageways extending therethrough in a vertical direction;

a plurality of contacts disposed in the corresponding passageways, respectively, each contact including:

a main body extending in a vertical plane and having a base with a pair of upper fixing members and a pair of lower fixing members extending therefrom;

a deflectable upper contacting arm including an upper vertical section extending from an upper side of the base, and an upper oblique sections extending upwardly from the upper vertical section with an upper contacting section at a free end thereof;

a deflectable lower contacting arm located below the upper contacting arm in the vertical direction and including a lower vertical section extending from a lower side of the base, and a lower oblique section extending downwardly from the lower vertical section with a lower contacting section at a free end thereof; and a pair of extension arms extending from the base and essentially between the upper fixing members and the lower fixing members in the vertical direction.

2. The electrical connector as claimed in claim 1, wherein the pair of extension arms is located at a waist portion of the contact.

3. The electrical connector as claimed in claim 1, wherein the pair of upper fixing arms are located by two sides of the upper vertical section in a transverse direction perpendicular to the vertical direction, and the pair of lower fixing arms are located by two sides of the lower vertical section in the transverse direction.

4. The electrical connector as claimed in claim 3, wherein in the transverse direction, a dimension of the upper oblique section is larger than that of the upper vertical section while being similar to a distance between the pair of extension arms.

5. The electrical connector as claimed in claim 3, wherein the pair of extension arms are spaced from each other in the transverse direction, and each extension arm extends in another vertical plane perpendicular to said vertical plane.

6. The electrical connector as claimed in claim 3, wherein in each contact, an opening extends in both the upper vertical section and the upper oblique section, and another opening extends in both the lower vertical section and the lower oblique section.

7. The electrical connector as claimed in claim 3, wherein the pair of upper fixing members are coplanar with both the base and the upper vertical section, and the pair of lower fixing members are coplanar with bot the base and the lower vertical section.

8. The electrical connector as claimed in claim 3, wherein the upper contacting arm extends in both the vertical direction and a longitudinal direction perpendicular to both the vertical direction and the transverse direction, the lower contacting arm extends in both the vertical direction and the longitudinal direction.

9. The electrical connector as claimed in claim 8, wherein the main body abuts against an interior surface of the passageway in the housing along the longitudinal direction while the pair of extension arms are spaced from any interior surfaces of the passageway in the housing.

10. The electrical connector as claimed in claim 8, wherein in the longitudinal direction, a dimension of the upper contacting arm is slightly smaller than that of the passageway so as to allow the contact to be upwardly assembled into the corresponding passageways from a lower side of the housing.

11. The electrical connector as claimed in claim 8, wherein each of the extension arms includes a narrow connecting section linked to the base, and an expanded section extending from the connecting section along the longitudinal direction.

12. The electrical connector as claimed in claim 11, wherein in the vertical direction, a dimension of the expanded section is larger than that of the connecting section.

13. An electrical connector comprising:

an insulative housing forming a plurality of passageways extending therethrough in a vertical direction;

a plurality of contacts disposed in the corresponding passageways, respectively, each contact including:

a main body extending in a vertical plane and having a base with a pair of upper fixing members and a pair of lower fixing members extending therefrom;

a deflectable upper contacting arm including an upper vertical section extending from an upper side of the base, and an upper oblique sections extending upwardly from the upper vertical section with an upper contacting section at a free end thereof; and a pair of extension arms extending from the base and essentially between the upper fixing members and the lower fixing members in the vertical direction; wherein the pair of upper fixing arms are located by two sides of the upper vertical section in a transverse direction perpendicular to the vertical direction, the pair of extension arms are space from each other in the transverse direction, and each extension arm extends in another vertical plane perpendicular to said vertical plane.

14. The electrical connector as claimed in claim 13, wherein the upper contacting arm extends in both the vertical direction and a longitudinal direction perpendicular to both the vertical direction and the transverse direction, and each of the extension arms includes a narrow connecting section linked to the base, and an expanded section extending from the connecting section along the longitudinal direction.

15. The electrical connector a claimed in claim 14, wherein a dimension of the expanded section is larger than that of narrow connecting section in the vertical direction.

16. The electrical connector as claimed in claim 15, wherein in the transverse direction, a dimension defined by the pair of upper fixing members is larger than that defined by the pair of extension arms.

17. The electrical connector as claimed in claim 16, wherein an opening extends in both the upper vertical section and the upper oblique section.

18. The electrical connector as claimed in claim 17, wherein in the transverse direction, a width of the upper oblique section is larger than that of the upper vertical section while being similar to the distance defined by the pair of extension arms.

19. A contact for use within a passageway in the housing of the electrical connector, comprising:

a main body extending in a vertical plane and having a base with a pair of upper fixing members and a pair of lower fixing members extending therefrom;

a deflectable upper contacting arm including an upper vertical section extending from an upper side of the base, and an upper oblique sections extending upwardly from the upper vertical section with an upper contacting section at a free end thereof;

a deflectable lower contacting arm located below the upper contacting arm in the vertical direction and including a lower vertical section extending from a lower side of the base, and a lower oblique section extending downwardly from the lower vertical section with a lower contacting section at a free end thereof; and a pair of extension arms extending from the base and essentially between the upper fixing members and the lower fixing members in the vertical direction.

20. The contact as claimed in claim 19, wherein the pair of upper fixing arms are located by two sides of the upper vertical section in a transverse direction perpendicular to the vertical direction, the pair of extension arms are space from each other in the transverse direction, and each extension arm extends in another vertical plane perpendicular to said vertical plane.

* * * * *